US010726987B2

(12) United States Patent
Takahashi et al.

(10) Patent No.: US 10,726,987 B2
(45) Date of Patent: Jul. 28, 2020

(54) COIL COMPONENT

(71) Applicant: TAIYO YUDEN CO., LTD., Chuo-ku, Tokyo (JP)

(72) Inventors: Shintaro Takahashi, Takasaki (JP); Chiharu Hayashi, Takasaki (JP); Atsushi Sado, Takasaki (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 187 days.

(21) Appl. No.: 15/960,380

(22) Filed: Apr. 23, 2018

(65) Prior Publication Data

US 2018/0315537 A1 Nov. 1, 2018

(30) Foreign Application Priority Data

Apr. 27, 2017 (JP) ..... 2017-088777

(51) Int. Cl.

| | |
|---|---|
| ***H01F 27/29*** | (2006.01) |
| ***H01F 27/02*** | (2006.01) |
| ***H01F 27/24*** | (2006.01) |
| ***H01F 27/28*** | (2006.01) |
| ***H01F 27/30*** | (2006.01) |
| ***H01F 17/04*** | (2006.01) |
| ***H01F 27/26*** | (2006.01) |

(52) U.S. Cl.

CPC ..... *H01F 27/02* (2013.01); *H01F 17/04* (2013.01); *H01F 27/24* (2013.01); *H01F 27/263* (2013.01); *H01F 27/28* (2013.01); *H01F 27/2828* (2013.01); *H01F 27/29* (2013.01); *H01F 27/292* (2013.01); *H01F 27/306* (2013.01)

(58) Field of Classification Search

USPC ..... 336/192

See application file for complete search history.

(56) References Cited

U.S. PATENT DOCUMENTS

| | | | | |
|---|---|---|---|---|
| 6,191,933 | B1 * | 2/2001 | Ishigaki | H01G 4/232 361/309 |
| 6,326,875 | B1 * | 12/2001 | Tuovinen | H01F 27/06 336/197 |
| 6,747,538 | B2 * | 6/2004 | Kuwata | H01F 17/045 336/192 |

(Continued)

FOREIGN PATENT DOCUMENTS

| | | | |
|---|---|---|---|
| JP | 2014044977 | A | 3/2014 |
| JP | 2014146642 | A | 8/2014 |
| JP | 2014220470 | A | 11/2014 |

*Primary Examiner* — Ronald Hinson

(74) *Attorney, Agent, or Firm* — Law Office of Katsuhiro Arai

(57) ABSTRACT

In an embodiment, a coil component includes: a core 10; a coil conductor 40 having a spiral part 42 placed inside the core 10, and a lead part 48 which is led out from the spiral part 42 to the principal outer surface, constituting the bottom face 28, of the core 10, and which includes an end part 46 that serves as an external terminal 49; an insulated terminal 60 electrically insulated from the coil conductor 40, which is fitted onto and bonded to the core 10, and which has a bottom part 64 positioned on the bottom face 28, a top part 62 positioned on the top face 26, and a side part 66 coupling the bottom part 64 and the top part 62, where the top part 62 and side part 66 have an opening 68 in which an adhesive 82 is filled.

7 Claims, 10 Drawing Sheets

(56) References Cited

U.S. PATENT DOCUMENTS

| | | | | |
|---|---|---|---|---|
| 6,940,708 | B2 * | 9/2005 | Yoshii | H01G 2/065 361/303 |
| 7,129,810 | B1 * | 10/2006 | Kimura | H01F 17/043 336/83 |
| 9,978,506 | B2 * | 5/2018 | Ohtsubo | H01F 27/255 |
| 10,249,429 | B2 * | 4/2019 | Arimitsu | H01F 27/24 |
| 2002/0067237 | A1 | 6/2002 | Nakata et al. | |
| 2007/0057758 | A1 * | 3/2007 | Sano | H01F 17/045 336/212 |
| 2009/0267718 | A1 * | 10/2009 | Nagano | H01F 27/006 336/65 |
| 2011/0102121 | A1 * | 5/2011 | Otsuka | H01F 27/06 336/192 |
| 2011/0260821 | A1 * | 10/2011 | Yamada | H01F 27/292 336/192 |
| 2016/0163442 | A1 | 6/2016 | Yoon et al. | |
| 2016/0351314 | A1 | 12/2016 | Jeong et al. | |
| 2016/0365191 | A1 * | 12/2016 | Horie | H01F 27/24 |
| 2017/0032888 | A1 | 2/2017 | Park et al. | |
| 2018/0315542 | A1 | 11/2018 | Hayashi | |

* cited by examiner

COIL COMPONENT

BACKGROUND

Field of the Invention

The present invention relates to a coil component.

Description of the Related Art

As applications of coil components widen, there is a demand for coil components offering high durability against vibration and impact. In the field of ceramic electric components, for example, installing a metal terminal on a chip component is known to provide an effect of protecting the chip component from impact, etc. (refer to Patent Literatures 1 to 3, for example).

Background Art Literatures

| | |
|---|---|
| [Patent Literature 1] | Japanese Patent Laid-open No. 2014-146642 |
| [Patent Literature 2] | Japanese Patent Laid-open No. 2014-220470 |
| [Patent Literature 3] | Japanese Patent Laid-open No. 2014-44977 |

SUMMARY

However, conventional coil components still have room for improvement in terms of durability against vibration and impact. The present invention was developed in light of this problem, and its object is to improve durability against vibration and impact.

Any discussion of problems and solutions involved in the related art has been included in this disclosure solely for the purposes of providing a context for the present invention, and should not be taken as an admission that any or all of the discussion were known at the time the invention was made.

The present invention is a coil component, comprising: a core; a coil conductor having: a spiral part placed inside the core; and a lead part which is led out from the spiral part to the principal outer surface, constituting the bottom face, of the core, and which includes an end part that will serve as an external terminal; a terminal electrically insulated from the coil conductor (hereinafter referred to as "dummy terminal" or "insulated terminal"), which is fitted onto and bonded to the core, and which has: a bottom part positioned on the bottom face of the core; a top part positioned on the top face opposite the bottom face; and a side part coupling the bottom part and the top part; where the top part and side part have an opening; and an adhesive filled in the opening in the dummy terminal.

The aforementioned constitution may be such that the opening extends from the top part to the side part.

The aforementioned constitution may be such that the dummy terminal has multiple openings, each corresponding to the aforementioned opening, in at least the top part or the side part.

The aforementioned constitution may be such that the multiple openings are provided in a lattice or staggered pattern.

The aforementioned constitution may be such that the opening is a circle or oval.

The aforementioned constitution may be such that the dummy terminal is bonded to the core at the top part and the side part, but not bonded to the core at the bottom part.

The aforementioned constitution may be such that the dummy terminal comprises the top part, the bottom part, and the side part coupling the top part and the bottom part, where the bottom part is shaped to have a larger area than the top part.

According to the present invention, durability against vibration and impact can be improved.

For purposes of summarizing aspects of the invention and the advantages achieved over the related art, certain objects and advantages of the invention are described in this disclosure. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Further aspects, features and advantages of this invention will become apparent from the detailed description which follows.

BRIEF DESCRIPTION OF THE DRAWINGS

These and other features of this invention will now be described with reference to the drawings of preferred embodiments which are intended to illustrate and not to limit the invention. The drawings are greatly simplified for illustrative purposes and are not necessarily to scale.

FIGS. 2A and 2B are perspective views of the top core, while

FIG. 8A is a side view of the coil component pertaining to Example 2, while

FIG. 9A is a side view of the coil component pertaining to Example 3, while

FIG. 10A is a side view of the coil component pertaining to Example 4, while

FIG. 12A is a side view of the coil component pertaining to Example 5, while

Figure 1A:
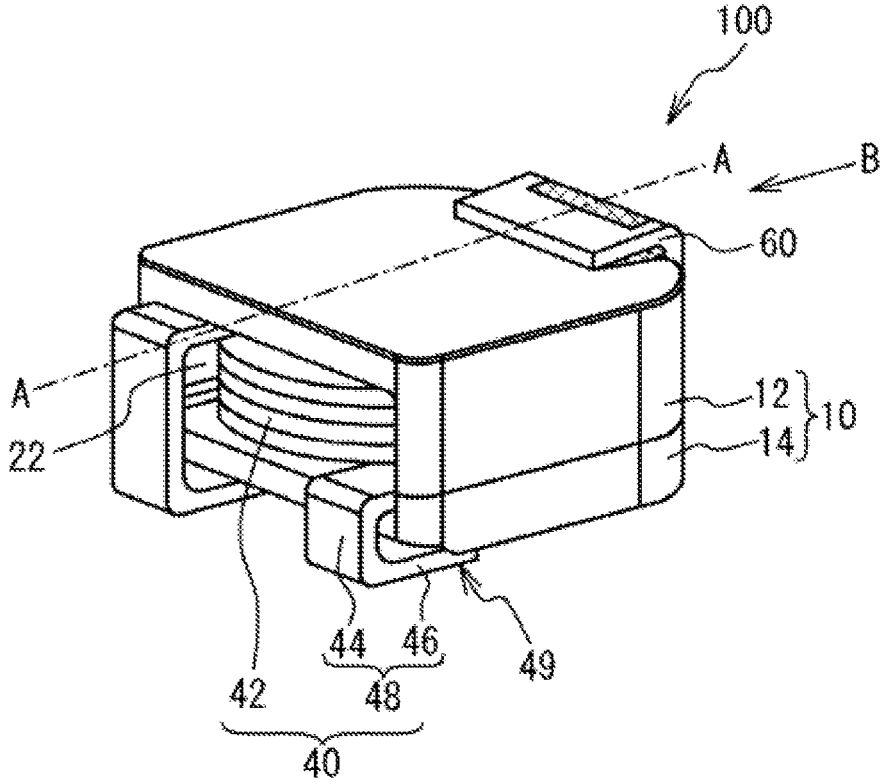
FIG. 1A is a perspective view.

| Description of the Symbols | |
|---|---|
| 10 | Core |
| 12 | Top core |
| 14 | Bottom core |
| 16 | Top part |
| 17 | Lid part |
| 18 | Bottom part |
| 19 | Base part |
| 20, 20a, 20b | Side part |
| 22, 22a, 22b | Hollow space |
| 24, 24a, 24b | Pillar part |
| 26 | Top face |
| 28 | Bottom face |
| 30 | Side face |
| 40 | Coil conductor |
| 42 | Spiral part |
| 44 | Connection part |
| 46 | End part |
| 48 | Lead part |
| 49 | External terminal |
| 60 to 60d | Dummy terminal |
| 62 | Top part |
| 64 | Bottom part |
| 66 | Side part |
| 68 | Opening |
| 80 to 84 | Adhesive |
| 100 to 500 | Coil component |

DETAILED DESCRIPTION OF EMBODIMENTS

Examples of the present invention are explained below by referring to the drawings.

EXAMPLE 1

Figure 1B:
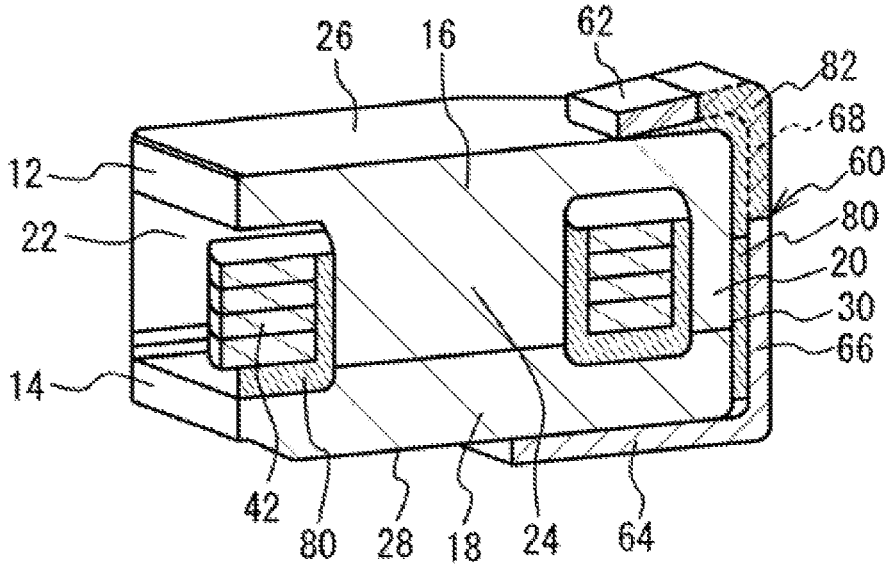
FIG. 1B is a perspective cross-sectional view along A-A in FIG. 1A, of the coil component pertaining to Example 1.

FIG. 1A is a perspective view, and FIG. 1B is a perspective cross-sectional view along A-A in FIG. 1A, of a coil component 100 pertaining to Example 1. It should be noted that, in the following explanations, the vertical direction is specified on the assumption that, when the coil component 100 is mounted on a circuit board, the circuit board is positioned vertically below the coil component 100. In addition, while a solder is provided to the end part 46 of the coil conductor 40 and the bottom part 64 of the dummy terminal 60, the solder is not illustrated in the figures below. As shown in FIGS. 1A and 1B, the coil component 100 in Example 1 is an inductor element comprising a core 10, a coil conductor 40, and a dummy terminal 60.

The core 10 is formed by joining a top core 12 and a bottom core 14 using an adhesive which is a thermosetting resin, etc., for example. The core 10 has a top part 16, a bottom part 18, a side part 20, and a hollow space 22 inside (a space remaining in the hollow space after placing therein the coil conductor may also be referred to as "a hollow space" depending on the context, e.g., in FIG. 1B). In plan view, the core 10 has a rectangular shape, one side of which is approx. 13 mm to 17 mm long, whose corners are rounded, and whose height is approx. 6 mm to 8.5 mm, for example. The core 10 opens on one side face side so that the hollow space 22 is exposed to the outside. The core 10 has a pillar part 24 in the hollow space 22. The pillar part 24 extends vertically between the top part 16 and the bottom part 18. It should be noted that a glass film of approx. 5 μm to 50 μm in thickness may be provided on the outer surface of the core 10. This improves the insulation property and anti-rust property.

Figure 2A:
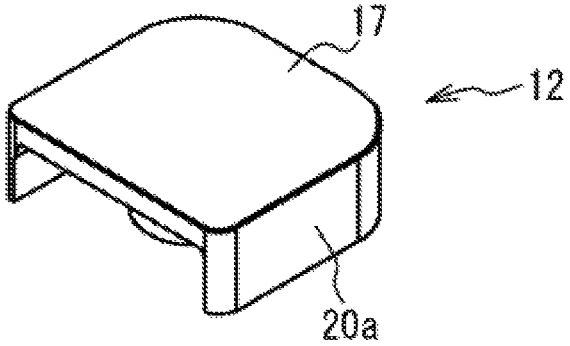
Figure 2B:
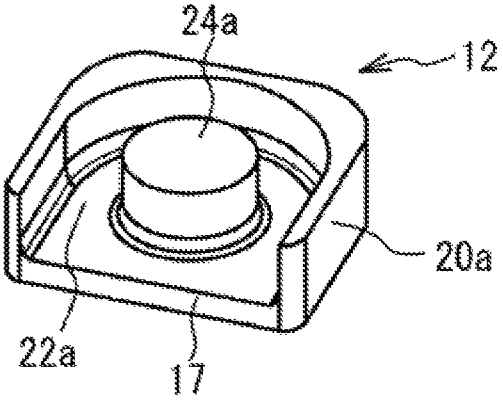
Figure 2C:
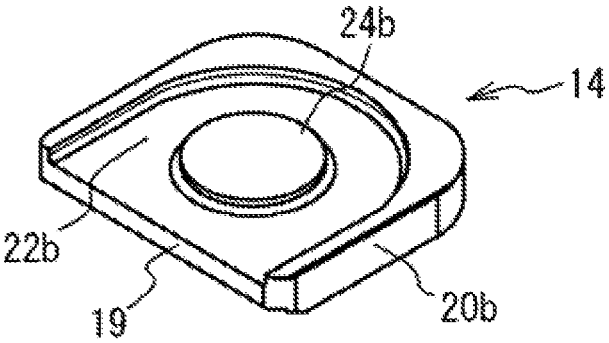
FIGS. 2C and 2D are perspective views of the bottom core.
Figure 2D:
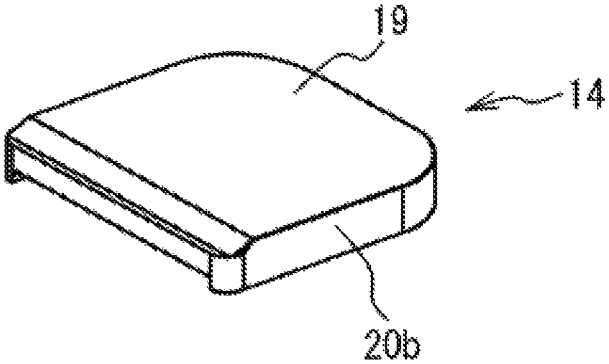

FIGS. 2A and 2B are perspective views of the top core 12, while FIGS. 2C and 2D are perspective views of the bottom core 14. FIGS. 2A and 2C are perspective views from above, while FIGS. 2B and 2D are perspective views from below.

As shown in FIGS. 2A and 2B, the top core 12 has a lid part 17 constituting the top part 16, and a side part 20*a*, and a hollow space 22*a* is formed inside. A cylindrical pillar part 24*a* is formed inside the hollow space 22*a*. The corners of the lid part 17 along the side part 20*a* and pillar part 24*a* are chamfered to round shapes. This improves durability against vibration and impact. The side part 20*a* and the pillar part 24*a* have roughly the same height, which is approx. 3 mm to 5 mm, for example. The diameter of the pillar part 24*a* is approx. 5 mm to 8 mm, for example. The top core 12 is formed by a magnetic material, such as a ferrite material or metal magnetic material, for example.

As shown in FIGS. 2C and 2D, the bottom core 14 has a base part 19 constituting the bottom part 18, and a side part 20*b*, and a hollow space 22*b* is formed inside. A cylindrical pillar part 24*b* is formed inside the hollow space 22*b*. The corners of the base part 19 along the side part 20*b* and pillar part 24*b* are chamfered to round shapes. The side part 20*b* and the pillar part 24*b* have roughly the same height, which is lower than the height of the side part 20*a* and pillar part 24*a* of the top core 12, and is approx. 2.0 mm to 2.5 mm, for example. The diameter of the pillar part 24*b* is roughly the same as that of the pillar part 24*a* of the top core 12, and is approx. 5 mm to 8 mm, for example. The bottom core 14 is formed by a magnetic material, such as a ferrite material or metal magnetic material identical to what the top core 12 is made of, for example.

As shown in FIGS. 1A, 1B, 2A through 2D, the side part 20*a* of the top core 12 and the side part 20*b* of the bottom core 14 are joined together to form the side part 20 of the core 10, while the pillar part 24*a* of the top core 12 and the pillar part 24*b* of the bottom core 14 are joined together to form the pillar part 24 of the core 10. It should be noted that the bottom core 14 may be formed by only a flat-shaped base part 19, without a side part 20*b* or pillar part 24*b*, and the core 10 may be formed by joining the side part 20*a* and pillar part 24*a* of the top core 12 to the flat-shaped base part 19 of the bottom core 14.

Figure 3A:
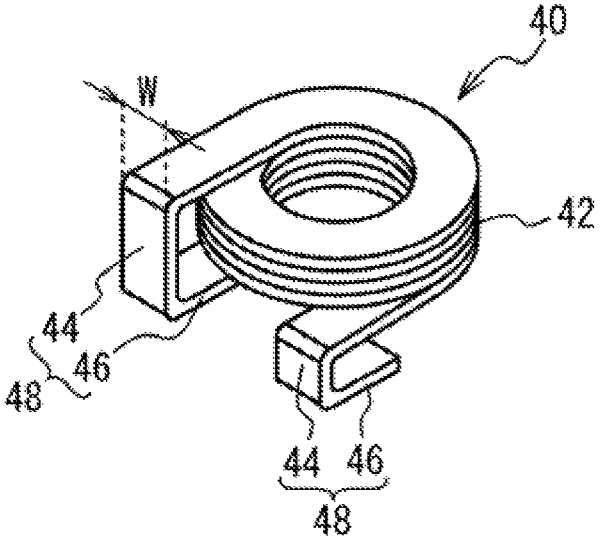
FIGS. 3A and 3B are perspective views of the coil conductor.
Figure 3B:
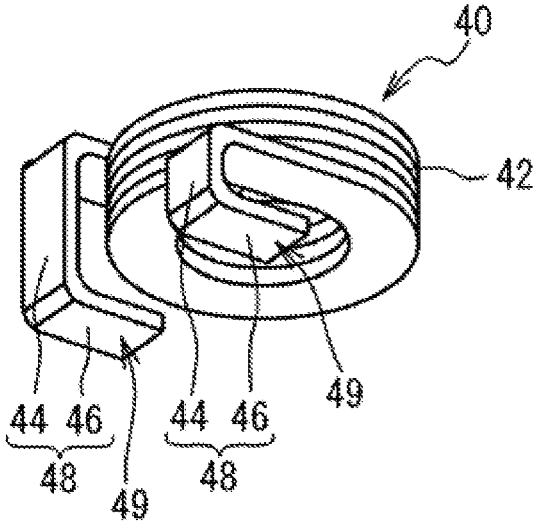

Next, the coil conductor 40 is explained using FIGS. 3A and 3B in addition to FIGS. 1A and 1B. FIGS. 3A and 3B are perspective views of the coil conductor 40. FIG. 3A is a perspective view from above, while FIG. 3B is a perspective view from below, of the coil conductor 40. The coil conductor 40 has a spiral part 42 which is placed around the pillar part 24 inside the hollow space 22 of the core 10, and a lead part 48 which is led out from the spiral part 42 toward the bottom face 28 of the core 10 and includes an end part 46 running in parallel with the bottom face 28 of the core 10. The lead part 48 includes a connection part 44 that connects the spiral part 42 and the end part 46.

An adhesive 80 is provided between the spiral part 42 and the core 10, and the spiral part 42 and the core 10 are bonded together by the adhesive 80. The adhesive 80 is a thermosetting resin, for example. By using a thermosetting resin for the adhesive 80, the heat resistance and bonding strength can be improved. The end part 46 will serve as an electrode when the coil component 100 is mounted on a circuit board. The width W of the coil conductor 40 is approx. 2.0 mm to 3.2 mm, for example. The coil conductor 40 is constituted by a conductive wire (such as copper (Cu) wire) with insulating sheath (such as polyamide imide). The coil conductor 40 is a flat wire coil, for example, but it may also be a wound wire coil. The end part 46 will serve as an external terminal 49 where a solder will be provided when the coil component 100 is mounted on a circuit board.

Figure 4A:
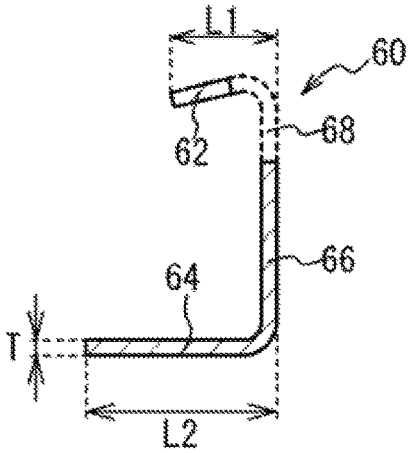
FIG. 4A is a cross-sectional view of the dummy terminal along A-A in FIG. 1A.
Figure 4B:
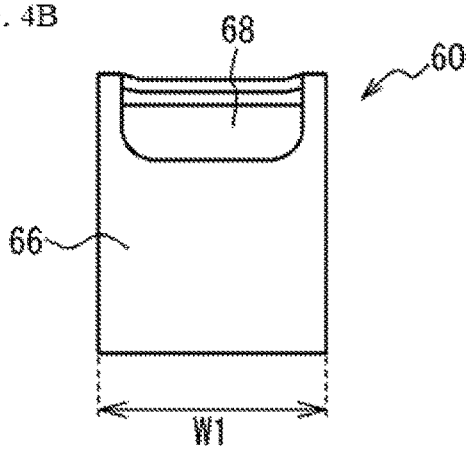
FIG. 4B is a plan view of the dummy terminal from the direction of B in FIG. 1A.
Figure 4C:
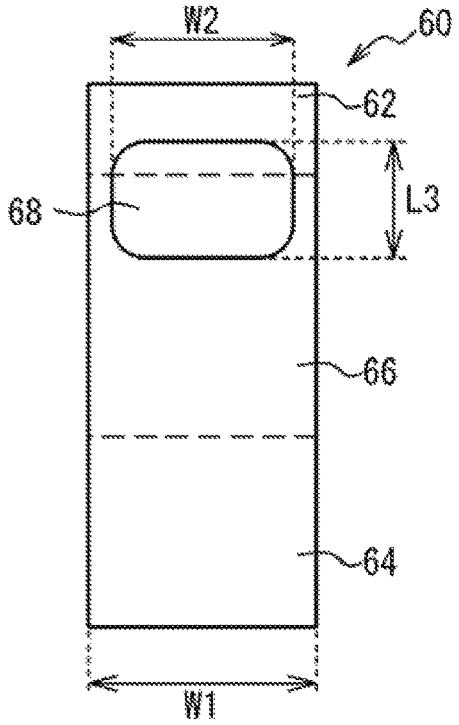
FIG. 4C is a plan view of the dummy terminal that has been extended flat.

Next, the dummy terminal 60 is explained using FIGS. 4A through 4C in addition to FIGS. 1A and 1B. FIG. 4A is a cross-sectional view of the dummy terminal 60 along A-A in FIG. 1A, FIG. 4B is a plan view of the dummy terminal 60 from the direction of B in FIG. 1A, and FIG. 4C is a plan view of the dummy terminal 60 that has been extended flat. The dummy terminal 60 is a terminal which is electrically insulated from the coil conductor 40 and has virtually no contribution to the electrical characteristics of the coil component 100. The dummy terminal 60 is installed on the core 10 in a manner extending from the top face 26, to the bottom face 28, via the side face 30, of the core 10. It should be noted that the bottom face 28 of the core 10 represents the principal outer surface of the core 10, the top face 26 is the face opposite the bottom face 28, and the side face 30 is the face connecting to the top face 26 and the bottom face 28. As described above, the dummy terminal 60 is shaped to have a top part 62 positioned on the top face 26, a bottom part 64 positioned on the bottom face 28, and a side part 66 coupling the top part 62 and the bottom part 64 and positioned on the side face 30, of the core 10. The area of the bottom part 64 is larger than the area of the top part 62. The dummy terminal 60 is positioned on the side face 30 of the core 10 opposite the side where the lead part 48 of the coil conductor 40 is led out, but it may be positioned in other locations. An adhesive 80 is provided between the side part 66 of the dummy terminal 60 and the core 10, and the side part 66 and the core 10 are bonded together by the adhesive 80.

The dummy terminal 60 is such that its top part 62 and side part 66 have an opening 68. The opening 68 extends from the top part 62 to the side part 66, for example. This means that the opening 68 is formed at a position encompassing the corners between the top part 16 and side part 20 of the core 10. The opening 68 has a rectangular shape whose corners are rounded, for example. An adhesive 82 is filled in the opening 68. In other words, the adhesive 82 is bonded to the side face of the dummy terminal 60 along the opening 68. The adhesive 82 may be a thermosetting resin, photosetting resin, or any other adhesive. The dummy terminal 60 is bonded to the core 10 at the side part 66 by the adhesive 80, and to the core 10 at the top part 62 and opening 68 by the adhesive 82, but it is not bonded to the core 10 at the bottom part 64 by an adhesive.

The dummy terminal 60 is formed by a copper (Cu) or copper (Cu) alloy plated with nickel (Ni) and tin (Sn), for example, but it may be formed by any other metal. The thickness T of the dummy terminal 60 is approx. 0.2 mm to 0.6 mm, for example. The dummy terminal 60 is such that the length L1 of the top part 62 is shorter than the length L2 of the bottom part 64. The length L1 of the top part 62 is approx. 2.6 mm to 3.5 mm, for example, while the length L2 of the bottom part 64 is approx. 5 mm to 6.2 mm, for example. The width W1 of the dummy terminal 60 is wider than the width W of the coil conductor 40, and is approx. 5.2 mm to 9 mm, for example. The length L3 of the opening 68 is approx. 2.5 mm to 3.4 mm, for example, while the width W2 is approx. 3.8 mm to 7.6 mm, for example. Also, the top part 62 is bent at a sharp angle relative to the side part 66.

Figure 5A:
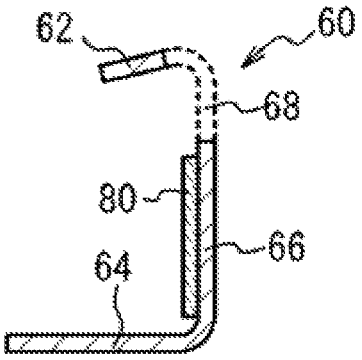
FIGS. 5A through 5C are cross-sectional views explaining the step to fit and bond the dummy terminal onto the core.
Figure 5B:
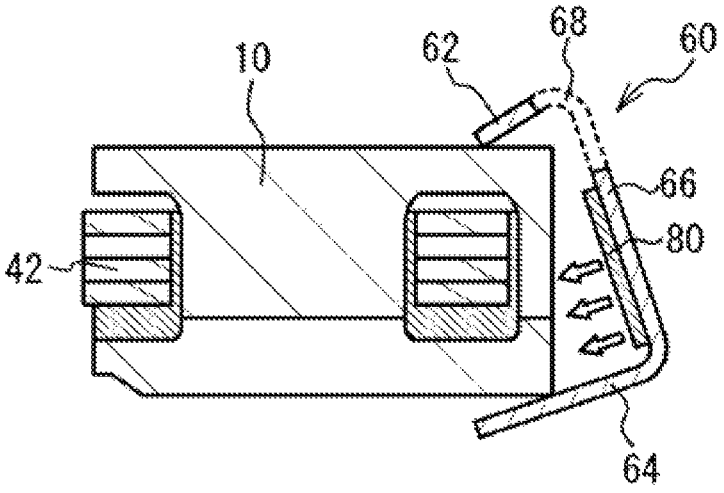
Figure 5C:
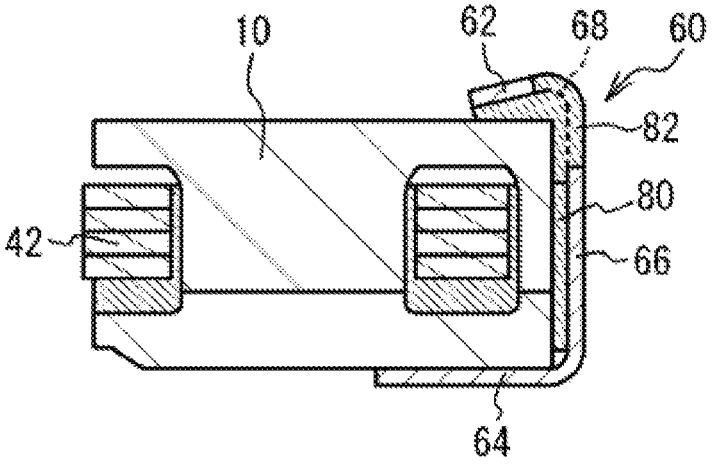

FIGS. 5A through 5C are cross-sectional views explaining the steps to fit and bond the dummy terminal 60 onto the core 10. As shown in FIG. 5A, the adhesive 80 is applied on the inner face of the side part 66 of the dummy terminal 60. As shown in FIG. 5B, the dummy terminal 60 is fitted onto the core 10. At this time, the opening 68 provided in the dummy terminal 60, in a manner extending from the top part 62 to the side part 66, allows for mitigation of the stress that generates in the dummy terminal 60 when it is fitted onto the core 10. As shown in FIG. 5C, the adhesive 82 is filled in the opening 68 in the dummy terminal 60. Through these steps, the dummy terminal 60 is fitted and bonded onto the core 10.

It should be noted that, for the adhesive 80 applied on the inner face of the side part 66 of the dummy terminal 60, preferably a thermosetting resin or other thermosetting adhesive is used because using a photosetting adhesive for this application is difficult. For the adhesive 82 filled in the opening 68 in the dummy terminal 60 per in FIG. 5C, on the other hand, a photosetting resin or other photosetting adhesive may be used, or a thermosetting resin or other thermosetting adhesive may be used. The adhesives 80, 82 may be made of the same material, or each adhesive may be made of a different material. Also, in FIG. 5A, the adhesive 80 may not be applied on the side part 66 of the dummy terminal 60. In other words, the dummy terminal 60 and the core 10 may be bonded together only by the adhesive 82 filled in the opening 68 in the dummy terminal 60.

Figure 6:
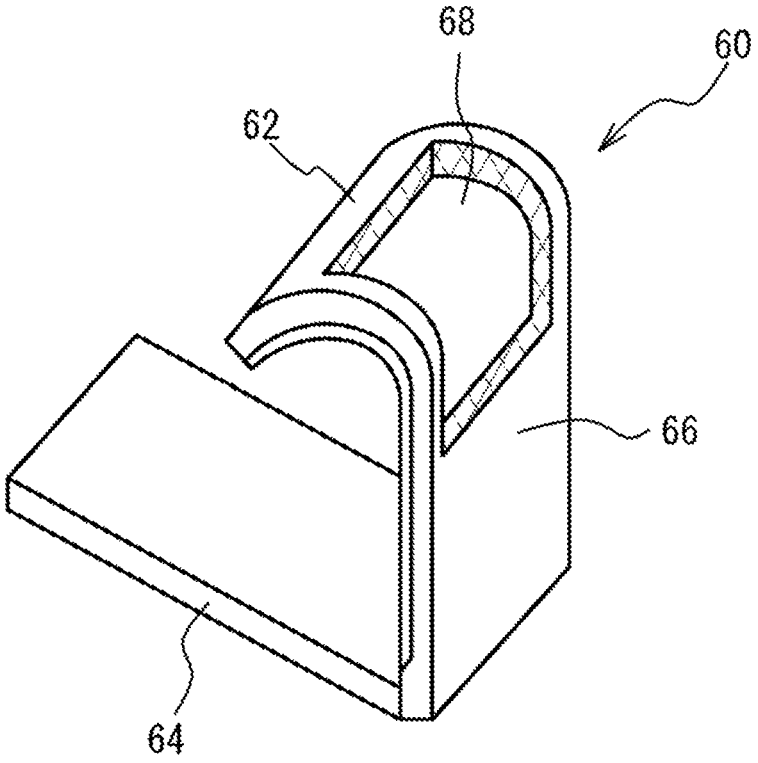
FIG. 6 is a drawing explaining the effects achieved by filling an adhesive in the opening in the dummy terminal.

Now, the effects of filling the adhesive 82 in the opening 68 extending from the top part 62, to the side part 66, of the dummy terminal 60, are explained. FIG. 6 is a drawing explaining the effects of filling the adhesive 82 in the opening 68 in the dummy terminal 60. When the adhesive 82 is filled in the opening 68, the side faces (cross-hatched areas) of the opening 68 contribute to the bonding of the dummy terminal 60, as shown in FIG. 6. If a shearing force generates in the dummy terminal 60 in the direction parallel with the top part 62 or side part 66 of the dummy terminal 60, then this shearing force is distributed over, among the side faces of the opening 68, those side faces that are orthogonal to the shearing force. This increases the force that resists the shearing force generating in the dummy terminal 60. If the opening 68 is provided only in the top part 62 or side part 66 of the dummy terminal 60, it becomes difficult to increase the force that resists the shearing force generating in the direction orthogonal to the opening 68. By providing the opening 68 in both the top part 62 and the side part 66, on the other hand, a shearing force that generates in the direction orthogonal to one opening 68 applies orthogonally to a part of the side face of the other opening 68, and the shearing force is distributed over this orthogonal side face, which in turn increases the force that resists the shearing force.

As describe above, in Example 1 the opening 68 is provided in the top part 62 and side part 66 of the dummy terminal 60, and the adhesive 82 is filled in this opening 68. This way, the force that resists the shearing force generating in the dummy terminal 60 can be increased, and durability against vibration and impact can be improved as a result.

Figure 7A:
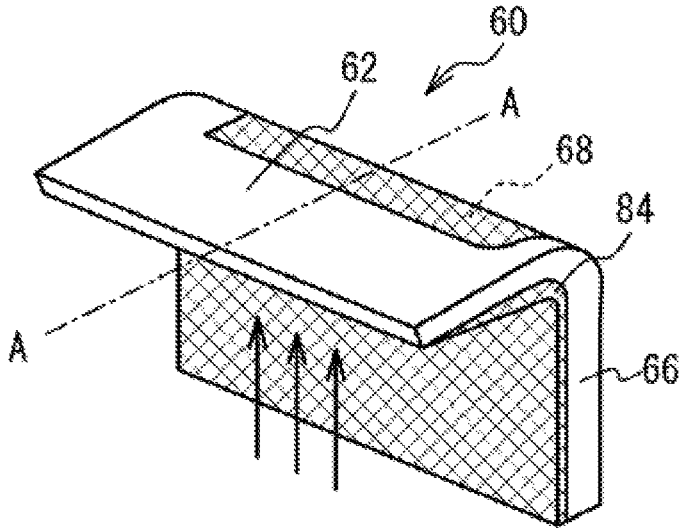
FIGS. 7A and 7C are perspective views.
Figure 7B:
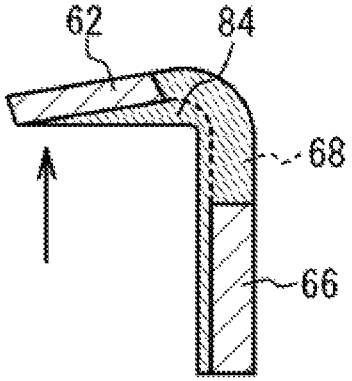
FIG. 7B is a cross-sectional view along A-A in FIG. 7A.
Figure 7C:
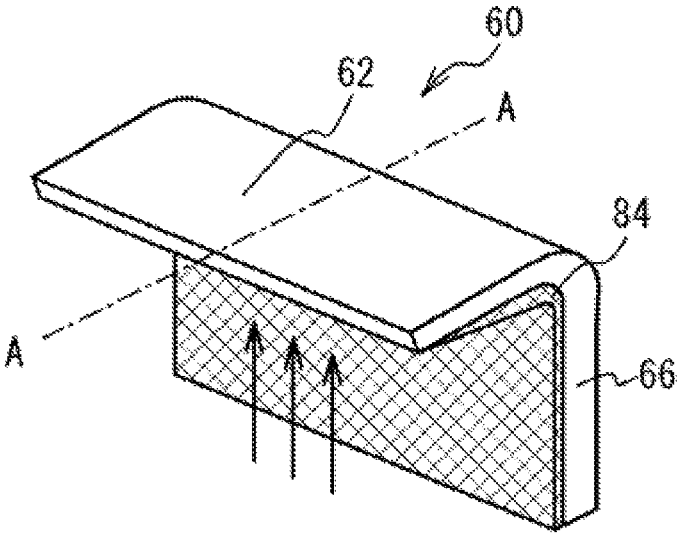
Figure 7D:
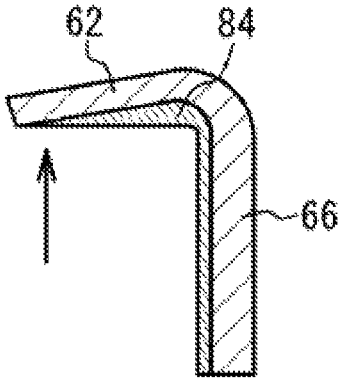
FIG. 7D is a cross-sectional view along A-A in FIG. 7C, of each dummy terminal used in a simulation.

Now, a stress simulation conducted on a dummy terminal 60 with an opening 68, and another on a dummy terminal 60 without opening 68, are explained. FIGS. 7A and 7C are perspective views, FIG. 7B is a cross-sectional view along A-A in FIG. 7A, and FIG. 7D is a cross-sectional view along A-A in FIG. 7C, of each dummy terminal 60 used in the simulation. As shown in FIGS. 7A and 7B, Example 1 represents a stress simulation conducted on a dummy terminal 60 in which an opening 68 was provided, with an adhesive 84 applied over the entire inner faces of the top part 62 and side part 66 and also filled in the opening 68. Additionally, as a comparative example, a stress simulation was conducted on a dummy terminal 60 in which no opening 68 was provided, with an adhesive 84 applied over the entire inner faces of the top part 62 and side part 66, as shown in FIGS. 7C and 7D. In the simulations, the stress that generated when a force was applied from below to the edge part of the top part 62, was calculated. It should be noted that each dummy terminal 60 was formed by phosphor bronze, and an epoxy resin was used for the adhesive 84. Also, each dummy terminal 60 was formed so that the top part 62 was 1.8 mm long, the side part 66 was 6.1 mm long, and their width was 7.0 mm, and the opening 68 had a size of 17.9 $mm^2$.

According to the results of the stress simulations, the maximum stress that generated in the dummy terminal 60 in Example 1, as shown in FIGS. 7A and 7B, was 1.80 MPa, while the maximum stress that generated in the dummy terminal 60 in the comparative example, as shown in FIGS. 7C and 7D, was 1.85 MPa. These simulation results show another effect, which is that providing an opening 68 in the dummy terminal 60 and then filling an adhesive 84 in the opening 68 improves the strength of the dummy terminal 60 itself Also, by providing an opening 68 in the dummy terminal 60 and filling an adhesive 82 in this opening 68, as shown in FIG. 1B, it can be confirmed from the outside that the dummy terminal 60 is bonded to the core 10 by the adhesive 82. This makes it easy to visually inspect the dummy terminal 60 for problems such as absence of adhesive.

A separate opening 68 may be provided in the top part 62, and also in the side part 66, of the dummy terminal 60; as shown in FIGS. 4A through 4C, however, preferably one opening is provided in a manner extending from the top part 62 to the side part 66. This way, as explained in FIG. 5B, the stress that generates in the dummy terminal 60 when the dummy terminal 60 is fitted onto the core 10, can be mitigated. The foregoing also improves the ease of bending the top part 62 of the dummy terminal 60, relative to the side part 66. From the aforementioned viewpoints of mitigating the stress and improving the ease of bending, the width W2 of the opening 68 is preferably at least one-half, or more preferably at least two-thirds, or most preferably at least three-fourths, the width W1 of the dummy terminal 60.

As shown in FIGS. 1A and 1B, the dummy terminal 60 may be bonded to the core 10 at the top part 62 and the side part 66, with the bottom part 64 not bonded to the core 10. The bottom face 28 of the core 10 constitutes a mounting surface which is mounted on a circuit board, which means that not bonding the bottom part 64 of the dummy terminal 60 to the core 10 with an adhesive prevents any contamination, potentially caused by such adhesive, of the base face of the external terminal 49 of the coil conductor 40, and this in turn prevents a mounting failure. Accordingly, the opening 68 may be provided in the top half of the side part 66 of the dummy terminal 60, closer to the top part 62, so as to prevent a mounting failure resulting from the external terminal 49 of the coil conductor 40 being contaminated by the adhesive 82 filled in the opening 68.

As shown in FIGS. 1A and 1B, the dummy terminal 60 may be shaped so that the bottom part 64 has a larger area than the top part 62. This makes it easy to fit the dummy terminal 60 onto the core 10, and also because a solder can be provided over a larger area for mounting on a circuit board, a secure mounting can be ensured.

It should be noted that, in Example 1, the side faces of the dummy terminal 60 in the opening 68 may be formed orthogonal, or tapered forward or backward.

EXAMPLE 2

Figure 8A:
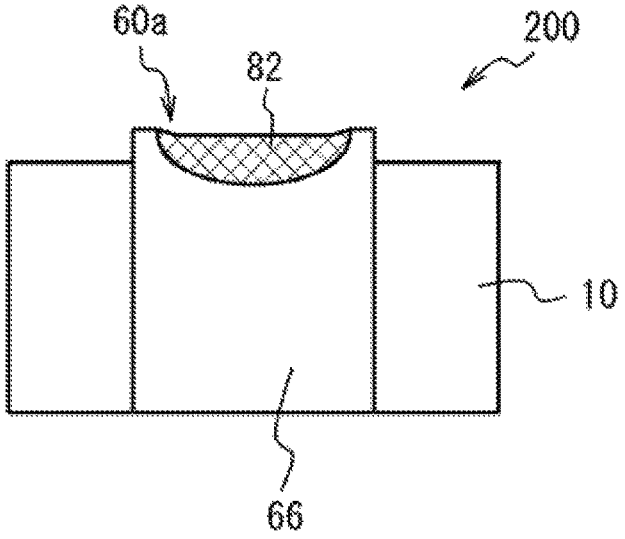
Figure 8B:
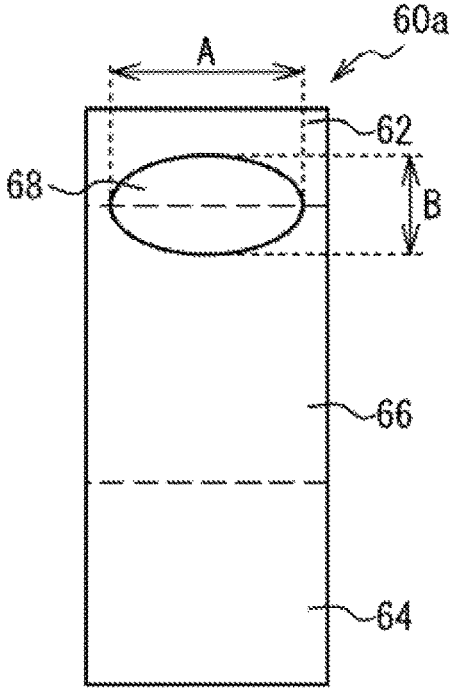
FIG. 8B is a plan view of its dummy terminal that has been extended flat.

FIG. 8A is a side view of a coil component 200 pertaining to Example 2, while FIG. 8B is a plan view of a dummy terminal 60*a* that has been extended flat. FIG. 8A is a side view corresponding to a view of the coil component 200 in Example 2from the direction of B in FIG. 1A. As shown in FIGS. 8A and 8B, the coil component 200 in Example 2 has an oval-shaped opening 68 provided in a manner extending from the top part 62, to the side part 66, of the dummy terminal 60*a*. The long diameter A of the opening 68 is approx. 6 mm, for example, while its short diameter B is approx. 5 mm, for example. The remaining constitutions are the same as those in Example 1 and therefore not explained.

According to Example 2, the opening 68 has an oval shape. When the opening 68 has an oval shape, it becomes easier to ensure that its side face has portions that are orthogonal or substantially orthogonal to a shearing force that may generate in the dummy terminal 60*a*, and therefore it becomes easier to distribute such shearing force generating in the dummy terminal 60*a* over the side face of the opening 68, compared to when the opening 68 has a rectangular shape. This means that, when the opening 68 has an oval shape, durability improves compared to when it has a rectangular shape. It should be noted that durability also improves when the opening 68 has a circular shape, just like when it has an oval shape.

EXAMPLE 3

Figure 9A:
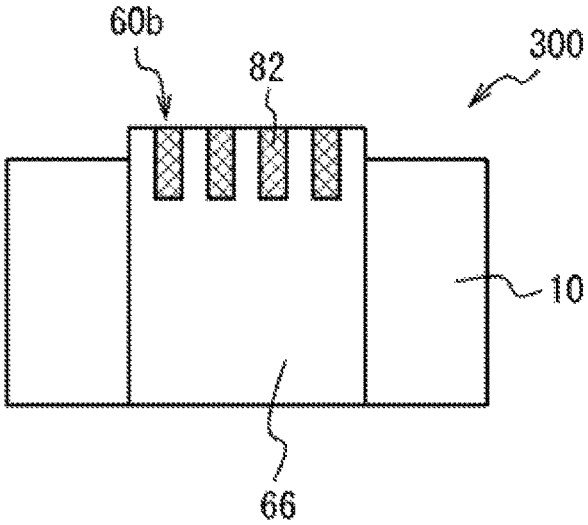
Figure 9B:
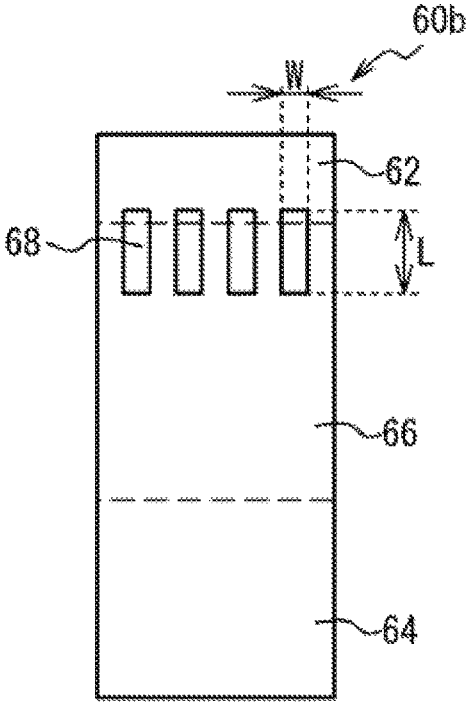
FIG. 9B is a plan view of its dummy terminal that has been extended flat.

FIG. 9A is a side view of a coil component 300 pertaining to Example 3, while FIG. 9B is a plan view of a dummy terminal 60*b* that has been extended flat. FIG. 9A is a side view corresponding to a view of the coil component 300 in Example 3 from the direction of B in FIG. 1A. As shown in FIGS. 9A and 9B, the coil component 300 in Example 3 has multiple openings 68 extending from the top part 62, to the side part 66, of the dummy terminal 60*b*. The length L of each opening 68 is approx. 3.2 mm, for example, while its width W is approx. 0.7 mm, for example. An adhesive 82 is filled in the multiple openings 68, respectively. The remaining constitutions are the same as those in Example 1 and therefore not explained.

According to Example 3, multiple openings 68 are provided in the top part 62, and also in the side part 66 of the dummy terminal 60*b*. The larger the area of the portion of the side face of the opening 68 which is orthogonal to a shearing force that may generate in the dummy terminal 60*b*, the greater the force becomes that resists the shearing force. Accordingly, the force that resists a shearing force generating in the dummy terminal 60*b* in its width direction is greater in Example 3 than in Example 1.

It should be noted that, in Example 3, the multiple openings 68 extend from the top part 62, to the side part 66, of the dummy terminal 60*b*; however, they may be formed to have a different shape. If the force that resists a shearing force generating in the dummy terminal 60*b* in a specific direction needs to be increased, for example, then the multiple openings 68 may be provided in such a way that the area of the portions of their side faces that are orthogonal to the specific direction increases.

EXAMPLE 4

Figure 10A:
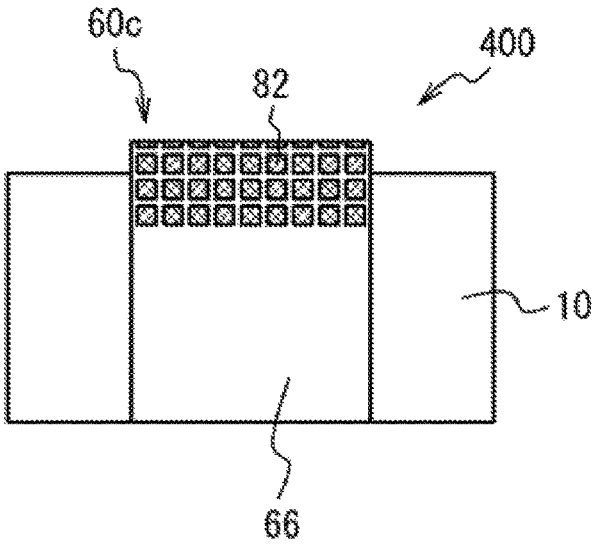
Figure 10B:
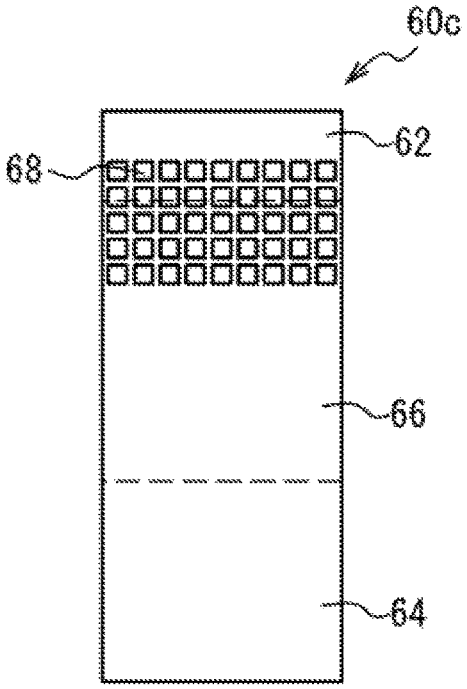
FIG. 10B is a plan view of its dummy terminal that has been extended flat.

FIG. 10A is a side view of a coil component 400 pertaining to Example 4, while FIG. 10B is a plan view of a dummy terminal 60*c* that has been extended flat. FIG. 10A is a side view corresponding to a view of the coil component 400 in Example 4 from the direction of B in FIG. 1A. As shown in FIGS. 10A and 10B, the coil component 400 in Example 4 has multiple openings 68 provided in the dummy terminal 60*c*, laid out in a lattice pattern and each having a rectangular shape. The multiple openings 68 have the same size, for example, which is approx. 0.5 mm long×0.5 mm wide, for example. It should be noted that the multiple openings 68 may include some openings 68 whose size is different from the other openings 68, or the sizes of all openings 68 may be different. An adhesive 82 is filled in the multiple openings 68, respectively. The remaining constitutions are the same as those in Example 1 and therefore not explained.

According to Example 4, the multiple openings 68 provided in the dummy terminal 60*c* are laid out in a lattice pattern. This way, the total area of the portions of the side faces of the openings 68 which are orthogonal to a shearing force that may generate in the dummy terminal 60*c* can be increased, and this in turn improves durability further.

Figure 11:
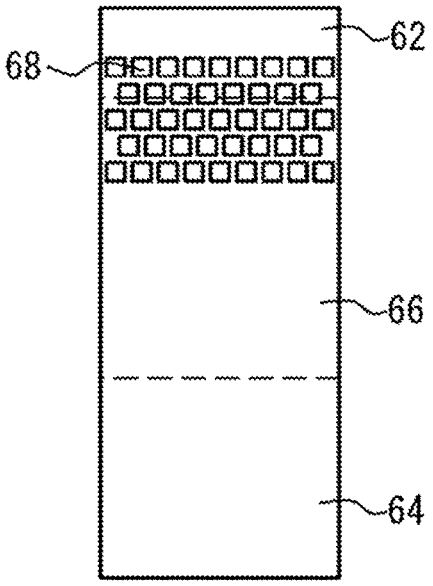
FIG. 11 is a drawing showing an example of another layout of multiple openings.

It should be noted that, in Example 4, multiple openings 68 are laid out in a lattice pattern; however, they may be laid out according to a different regularity, or they may be laid out irregularly. FIG. 11 is a drawing showing an example of another layout of multiple openings 68. As shown in FIG. 11, the multiple openings 68 may be laid out in a staggered pattern.

EXAMPLE 5

Figure 12A:
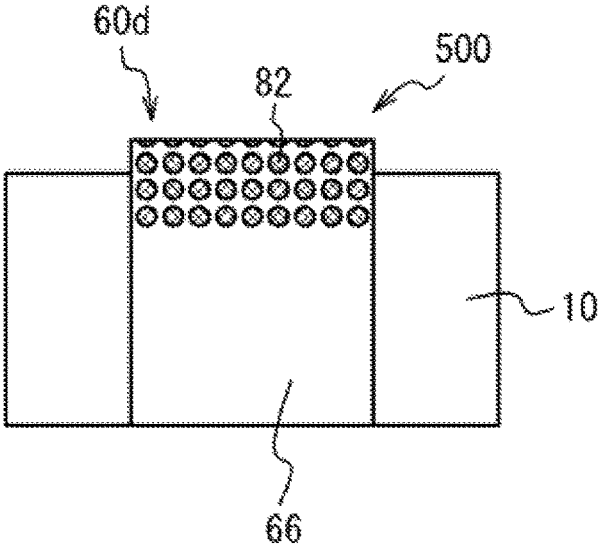
Figure 12B:
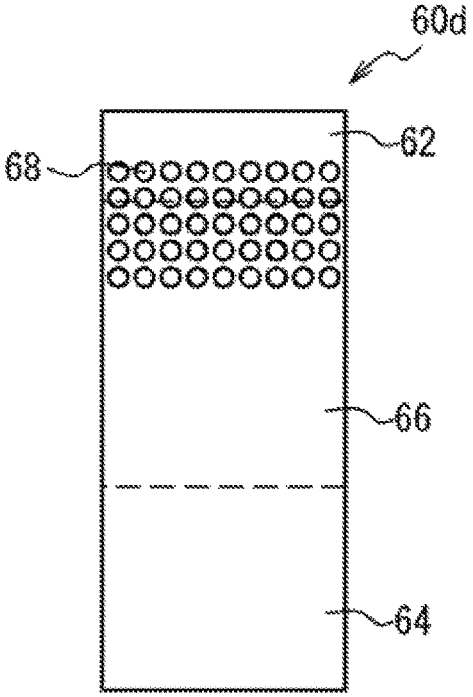
FIG. 12B is a plan view of its dummy terminal that has been extended flat.

FIG. 12A is a side view of a coil component 500 pertaining to Example 5, while FIG. 12B is a plan view of a dummy terminal 60*d* that has been extended flat. FIG. 12A is a side view corresponding to a view of the coil component 500 in Example 5 from the direction of B in FIG. 1A. As shown in FIGS. 12A and 12B, the coil component 500 in Example 5 has multiple openings 68 provided in the dummy terminal 60*d*, laid out in a lattice pattern and each having a circular shape. The multiple openings 68 have the same size, for example, which is approx. 0.5 mm in diameter, for example. It should be noted that the multiple openings 68 may include some openings 68 whose size is different from the other openings 68, or the sizes of all openings 68 may be different. An adhesive 82 is filled in the multiple openings 68, respectively. The remaining constitutions are the same as those in Example 1 and therefore not explained.

According to Example 5, the multiple openings 68 provided in the dummy terminal 60*d* are laid out in a lattice pattern and each has a circular shape. As explained in Example 2, when each opening 68 has an oval or circular shape, it becomes easier to ensure that its side face has portions that are orthogonal or substantially orthogonal to a shearing force that may generate in the dummy terminal 60*d*, and therefore it becomes easier to distribute such shearing force generating in the dummy terminal 60*d* over the side face of the opening 68. As a result, durability improves in Example 5 compared to that in Example 4.

It should be noted that, while multiple openings 68 are provided in the top part 62, and also in the side part 66, of the dummy terminal in Examples 3 through 5, multiple openings 68 may be provided in one of the top part 62 and side part 66, and only one opening 68 may be provided in the other. In other words, multiple openings 68 may be provided in at least one of the top part 62 and side part 66.

The foregoing described the examples of the present invention in detail; it should be noted, however, that the present invention is not limited to these specific examples and that various modifications and changes may be added to the extent that the results do not deviate from the key points of the present invention described in "What Is Claimed Is."

In the present disclosure where conditions and/or structures are not specified, a skilled artisan in the art can readily provide such conditions and/or structures, in view of the present disclosure, as a matter of routine experimentation. Also, in the present disclosure including the examples described above, any ranges applied in some embodiments may include or exclude the lower and/or upper endpoints, and any values of variables indicated may refer to precise values or approximate values and include equivalents, and may refer to average, median, representative, majority, etc. in some embodiments. Further, in this disclosure, "a" may refer to a species or a genus including multiple species, and "the invention" or "the present invention" may refer to at least one of the embodiments or aspects explicitly, necessarily, or inherently disclosed herein. The terms "constituted by" and "having" refer independently to "typically or broadly comprising", "comprising", "consisting essentially of", or "consisting of" in some embodiments. In this disclosure, any defined meanings do not necessarily exclude ordinary and customary meanings in some embodiments.

The present application claims priority to Japanese Patent Application No. 2017-088777, filed Apr. 27, 2017, the disclosure of which is incorporated herein by reference in its entirety including any and all particular combinations of the features disclosed therein.

It will be understood by those of skill in the art that numerous and various modifications can be made without departing from the spirit of the present invention. Therefore, it should be clearly understood that the forms of the present invention are illustrative only and are not intended to limit the scope of the present invention.

We claim:

1. A coil component, comprising:

a core;

a coil conductor comprising: a spiral part placed inside the core; and a lead part which is led out from the spiral part to a principal outer surface, constituting a bottom face, of the core, and which includes an end part that serves as an external terminal;

an insulated terminal electrically insulated from the coil conductor, which is snap-fitted onto and bonded to the core, and which has: a bottom part positioned on the bottom face of the core; a top part positioned on a top face opposite the bottom face; and a side part coupling the bottom part and the top part; where the top part and side part have an opening; and an adhesive filled in the opening in the insulated terminal.

2. The coil component, according to claim 1, wherein the opening extends continuously from the top part to the side part.

3. The coil component according to claim 1, wherein the insulated terminal has a plurality of the openings in at least the top part or the side part.

4. The coil component according to claim 1, wherein the insulated terminal is bonded to the core at the top part and the side part, but not bonded to the core at the bottom part.

5. The coil component according to claim 1, wherein the insulated terminal comprises the top part, the bottom part, and the side part coupling the top part and the bottom part, where the bottom part is shaped to have a larger area than does the top part.

6. The coil component according to claim 1, wherein the opening is a circle or oval.

7. The coil component according to claim 3, wherein the plurality of the openings are provided in a lattice or staggered pattern.

* * * * *